United States Patent [19]

Kluger et al.

[11] 4,082,205

[45] Apr. 4, 1978

[54] BASE FOR A FINE MATERIAL CONTAINER

[75] Inventors: Wolfgang Kluger, Neubeckum; Jürgen Neumann, Oelde, both of Germany

[73] Assignee: Polysius AG, Neubeckum, Germany

[21] Appl. No.: 702,342

[22] Filed: Jul. 2, 1976

[30] Foreign Application Priority Data

Jul. 23, 1975 Germany ..... 7523514[U]

[51] Int. Cl.[2] ..... B67D 5/54

[52] U.S. Cl. ..... 222/193; 302/53

[58] Field of Search ..... 302/51–53, 302/57; 222/193–195; 34/57 R, 57 A

[56] References Cited

U.S. PATENT DOCUMENTS

| | | | |
|---|---|---|---|
| 3,189,460 | 6/1965 | Smith | 34/57 A |
| 3,226,166 | 12/1965 | Bertolini et al. | 302/52 |
| 3,351,106 | 11/1967 | Moulthrop | 222/193 |
| 3,514,158 | 4/1968 | Stahler et al. | 302/52 |
| 3,989,147 | 11/1976 | Fried | 302/52 |

*Primary Examiner*—Robert B. Reeves
*Assistant Examiner*—H. Grant Skaggs
*Attorney, Agent, or Firm*—Learman & McCulloch

[57] ABSTRACT

A base for a container for fine material adapted to be discharged pneumatically from the container. The container base has a generally central material outlet in communication with a number of pneumatic feed channels extending radially inwardly from the periphery, the channels dividing the container base into sector-like sections. Each such section has two upwardly converging, oblique surfaces which meet along a ridge-like edge extending towards the container center and at least one of such surfaces is aeratable from below. Overlying each feed channel is an aeratable, downwardly inclined cover having one or more openings at the periphery of the base through which material may pass into the channel.

12 Claims, 3 Drawing Figures

FIG. 2
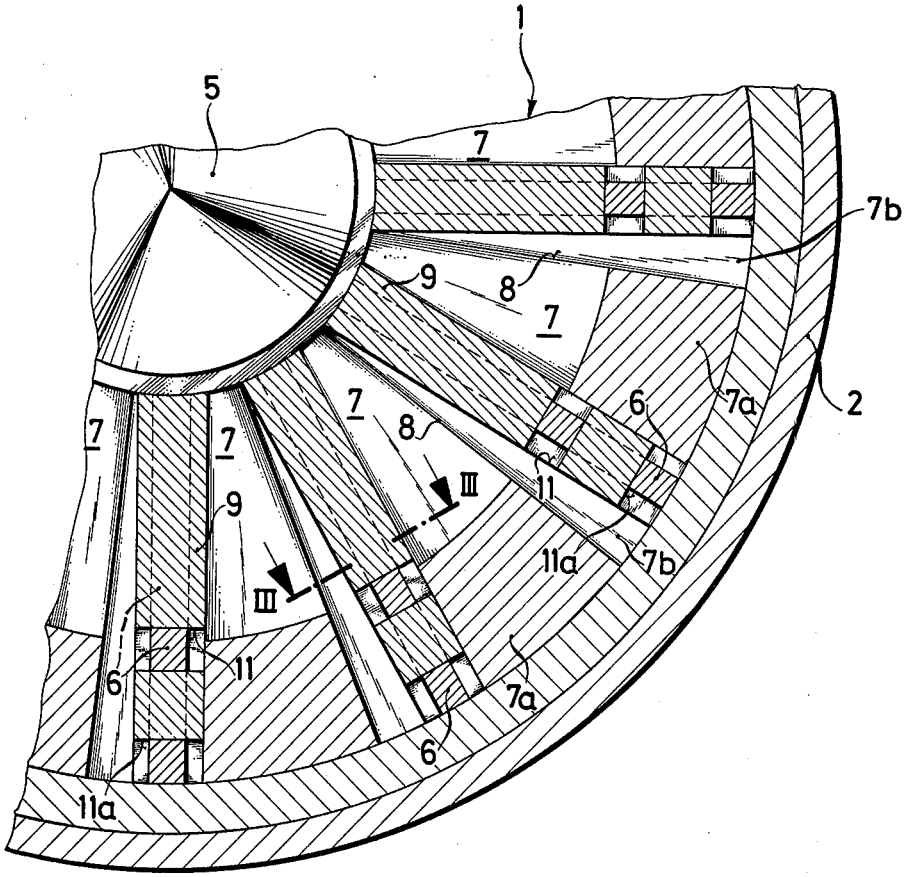
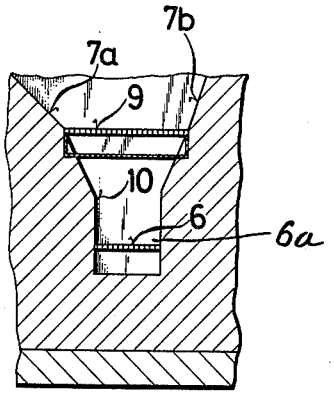
FIG. 3

BASE FOR A FINE MATERIAL CONTAINER

Container bases of the kind to which the invention relates frequently are used in mixing and discharge silos, especially silos adapted for the storage and intimate mixing of powdery material.

With known silo constructions it has frequently been found in practice, especially with the larger diameter containers and container bases, that difficulties arise with respect to uniform sinking of the column of material during discharge, i.e., in general the central zone of the column sinks more rapidly than the outer zone, so that (as seen in the silo cross-section) a species of cone or funnel is produced over the central discharge apertures, and hence the material in the zone above the outer periphery of the container base flows scarcely or not at all thus preventing uniform discharge.

The invention thus has for its objective the provision of a container base which permits the column of material resting above the base to sink uniformly over the entire cross-section.

According to the invention this objective is attained by means of a porous cover provided above each pneumatic feed channel and inclined downwardly towards the outer periphery of the container base. In this manner the material disposed above the container base may be aerated and is forced to move in a direction towards the outer periphery of the container base or a wall of the silo, in which zone it can then enter the pneumatic feed channel. This construction in accordance with the invention therefore from the start prevents the central zone of the column of material reaching the central outlet aperture first. The porous of the covers and their inclination ensure however that during the discharge operation not only the peripheral zone of the column of material but also the central zone of the column is removed into the pneumatic feed channels and thence to the outlet aperture, so that in every case the column of material can sink extremely uniformly over the entire cross-section.

Depending on the size and design of the container base and of the corresponding container or silo, each cover has only one material aperture provided near the outer periphery of the container base for discharge into the pneumatic feed channel, or (in particular for the larger diameter containers) each cover can be provided with at least two material apertures for discharging material into the corresponding pneumatic feed channel in the vicinity of the outer periphery of the container base.

The invention will be described in more detail below, with reference to an embodiment shown in the drawings. In these:

FIG. 2 is a partial plan view of the container base shown in FIG. 1;

FIG. 3 is a section on the line III—III in FIG. 2.

Figure 1:
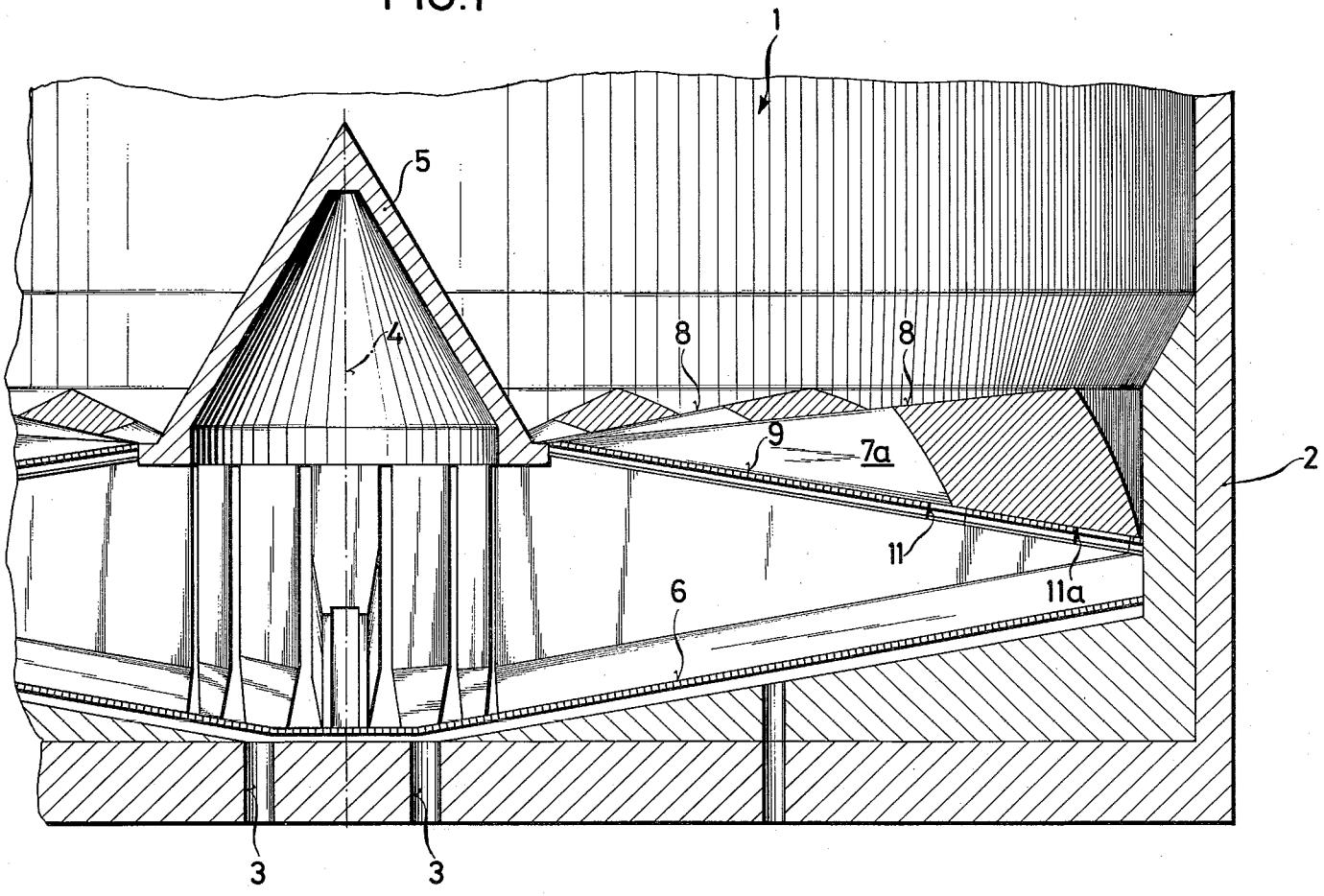
FIG. 1 is a vertical section through a portion of a silo having a container base constructed in accordance with the invention.

The drawings show only the features considered necessary for explaining the invention, and for clarity's sake details such as pipes, pipe fittings, individual aerating units for inclined surfaces, etc., are omitted as they are well known to any technician skilled in this art.

The container base 1 shown in the drawings is used for the pneumatic discharge of fine material (e.g., ground raw cement). In the present case it is installed at the bottom of a mixing or discharge silo 2.

The bottom of the silo 2 has a material outlet, disposed generally centrally, which can comprise either a single central discharge aperture or as in the case of FIG. 1 (for large diameter containers) a number of discharge apertures 3 arranged generally symmetrically about the central axis 4 of the container base 1 and the silo. In the disclosed embodiment a generally conical discharge cap 5 overlies the discharge aperture. The external surface of the cap can be porous if desired.

As is shown especially clearly in FIG. 2, the container base 1 has a number of pneumatic feed channels **6*a* having vertical sides 10 and a porous bottom 6 beneath which aerating gas may flow. The channels extend radially inwardly and are inclined downwardly from the periphery toward the central discharge aperture and the bottom 6 of each channel has a discharge opening (not shown) in communication with the central discharge aperture 3. The channels 6*a* divide the container base 1 into circumferentially spaced sector-like sections 7. Each of the sections 7 has two oblique surfaces 7*a* and 7*b* which converge upwardly and meet along a ridge-like edge 8 extending toward the centre of the container. In the embodiment shown the oblique surfaces have different inclinations to the horizontal. For example, the surface 7*a* has a flatter slope while surface 7*b* is more steeply inclined. Confronting oblique surfaces 7*a* and 7*b* are inclined downwardly and towards one another and merge with upstanding sides 10 of the associated feed channel 6*a*** at the upper part thereof.

Preferably only the less steeply inclined oblique surfaces **7*a* of each sector-like section 7 is porous to permit aeration of the material from below in a known manner; in general it has been found especially desirable if only the outermost section, nearest the outer periphery of the base, of each oblique surface is porous, as represented by the shaded area in FIGS. 1 and 2**.

An important feature of the construction provided by the invention is that above the bottom 6 of each pneumatic feed channel **6*a* there is provided a porous cover 9 inclined downwardly towards the outer edge of the container base 1. These covers 9 extend (see especially FIG. 1) from the discharge cap 5 towards the outer periphery of the container 1. It will be obvious that for embodiments without a discharge cap, the covers extend from about the centre of the container to its edge. Each cover 9** has an air passage therein in communication with the perforations at the upper side of the cover.

In the peripheral direction (i.e., transversely) each cover 9 is disposed at about the transition zone between the oblique surfaces **7*a*, 7*b* and the upstanding sides 10 of the associated pneumatic feed channel 6*a*, as is best shown in FIG. 3. This arrangement of the covers 9** very effectively avoids dead spots, in which material can settle.

Each cover 9 has one or more material discharge apertures **11, 11*a* through which the material being extracted reaches the pneumatic feed channel 6*a***. In every case however it is preferred that the apertures for discharging material into the pneumatic feed channels be provided near the outer edge of the container base.

For silos or containers of relatively small diameter only a single aperture for discharge into the associated pneumatic conveyor channel near the outer edge of the base will suffice, whereas for containers of larger diameters, as in the embodiment shown, it is preferable to provide at least two material discharge apertures **11, 11*a*** both disposed near the outer edge of the container base 1, so that both the material resting in the central zone above the base and the material near the periphery is forced to enter the associated pneumatic feed channel 6*a* in the vicinity of the silo wall, which ensures that the column of material sinks with great uniformity over the entire cross-section.

A further possible influence on improved discharge of material from a silo can be achieved if the porous sections of the oblique surfaces, the pneumatic feed channels and the covers have different portions supplied with air at different pressures, the air being supplied by conventional ducting.

We claim:

1. A circular base member for a fine material container having a floor provided with a generally centrally located outlet through which such material may be discharged, said base member comprising a bottom having a plurality of circumferentially spaced feed channels therein extending radially inwardly from the periphery of said base member and inclined downwardly toward and in communication with said outlet, the spaces between adjacent channels forming sector-like sections, and a cover interposed between each of said sections and overlying the associated channel, each of said covers being porous for the passage therethrough of aerating gas, each of said covers being inclined downwardly and radially outwardly toward the periphery of said base member, and each of said covers having therein at least one material discharge aperture adjacent the periphery of said base and in communication with the associated feed channel.

2. A base according to claim 1 wherein each of said sector-like sections has two upwardly converging surfaces which meet and form a ridge extending toward the centre of said base.

3. A base according to claim 2 wherein at least one of said surfaces is porous for the passage of aerating gas from below.

4. A base according to claim 2 wherein the converging surfaces of each of said sector-like sections are inclined at different angles to the horizontal.

5. A base according to claim 4 wherein the surface having the lesser inclination to the horizontal is porous.

6. A base according to claim 1 wherein each of said covers has more than one discharge aperture therein, each of which is located adjacent the periphery of said base.

7. A base according to claim 1 including a generally conical discharge cap overlying said material outlet and wherein each of said covers extends from the periphery of said cap toward the periphery of said base.

8. A base according to claim 1 wherein said central material outlet comprises at least one opening.

9. A base according to claim 1 wherein said central material outlet comprises a plurality of openings.

10. A base according to claim 9 wherein said openings are arranged substantially symmetrically about the centre of said base.

11. A base according to claim 1 wherein each of said channels has a porous bottom.

12. A base according to claim 1 wherein each of said channels has upwardly extending sides having upwardly and outwardly diverging upper surfaces, and wherein the cover for each of said channels is located substantially at the zone of transition between said sides and said upwardly converging surfaces.

* * * * *